US012035808B2

(12) United States Patent
Jablonski et al.

(10) Patent No.: US 12,035,808 B2
(45) Date of Patent: Jul. 16, 2024

(54) MECHANISM FOR TRANSFORMING FURNITURE FROM A SITTING POSITION TO A LYING DOWN POSITION

(71) Applicant: STALMOT & WOLMET sp. z.o.o., Nidzica (PL)

(72) Inventors: Pawel Jablonski, Nidzica (PL); Mariusz Borkowski, Nidzica (PL)

( * ) Notice: Subject to any disclaimer, the term of this patent is extended or adjusted under 35 U.S.C. 154(b) by 108 days.

(21) Appl. No.: 17/499,493

(22) Filed: Oct. 12, 2021

(65) Prior Publication Data

US 2022/0160136 A1 May 26, 2022

(30) Foreign Application Priority Data

Nov. 20, 2020 (PL) ..... 436042

(51) Int. Cl.
*A47C 17/165* (2006.01)
*A47C 17/13* (2006.01)
(Continued)

(52) U.S. Cl.
CPC ..... *A47C 17/1655* (2013.01); *A47C 17/13* (2013.01); *A47C 17/132* (2013.01);
(Continued)

(58) Field of Classification Search
CPC ..... A47C 17/1655; A47C 17/2076; A47C 17/32; A47C 17/16; A47C 17/161; A47C 17/162; A47C 17/163; A47C 17/165; A47C 17/17; A47C 17/175; A47C 17/1756; A47C 17/13; A47C 17/132; A47C 17/134; A47C 17/136; A47C 17/138; A47C 17/14;
(Continued)

(56) References Cited

U.S. PATENT DOCUMENTS 3,657,747 A * 4/1972 Rogers, Jr. ..... A47C 17/1756 5/29
8,438,676 B2 * 5/2013 Murphy ..... A47C 3/16 5/28
2007/0283491 A1 * 12/2007 Murphy ..... A47C 17/213 5/13
2013/0019400 A1 * 1/2013 Stieglitz ..... A47C 7/506 5/43

FOREIGN PATENT DOCUMENTS

DE 102017107367 A1 * 5/2018 ..... A47C 17/134
PL 68476 Y1 7/2016
PL 223934 B1 * 11/2016

*Primary Examiner* — David R Hare
*Assistant Examiner* — Deborah Talitha Gedeon
(74) *Attorney, Agent, or Firm* — Egbert, McDaniel & Swartz, PLLC

(57) ABSTRACT

A mechanism for transforming furniture from a sitting position to a lying down position has right and left jacks with identical design, which are a mirror reflection of each other, connected by a synchronisation mechanism. Each jack has a fastening plate which attaches the jack to the furniture body, angle bars, upper and lower for connecting with the mattresses, a spring and a front pull rod and rear pull rod with centre arms. Each jack has a backrest driving sub-assembly created from a backrest rotation pull rod and support to be connected with the backrest of the furniture, whereas the backrest rotation pull rod is connected in an articulated manner on one end with the bottom end of the rear pull rod, and on the second end is connected in an articulated manner with the support connected in an articulated manner to the fastening plate.

8 Claims, 10 Drawing Sheets

(51) Int. Cl.

| | |
|---|---|
| ***A47C 17/14*** | (2006.01) |
| ***A47C 17/16*** | (2006.01) |
| ***A47C 17/17*** | (2006.01) |
| ***A47C 17/175*** | (2006.01) |
| ***A47C 17/32*** | (2006.01) |

(52) U.S. Cl.
CPC ..... *A47C 17/14* (2013.01); *A47C 17/16* (2013.01); *A47C 17/161* (2013.01); *A47C 17/162* (2013.01); *A47C 17/163* (2013.01); *A47C 17/165* (2013.01); *A47C 17/17* (2013.01); *A47C 17/175* (2013.01); *A47C 17/32* (2013.01)

(58) Field of Classification Search
CPC ..... A47C 17/34; A47C 17/36; A47C 17/213; A47C 17/23; A47C 1/0352; A47C 13/00; A47C 17/04; A47C 17/2073; A47C 3/16; A47C 7/38; A47C 7/50; A47C 17/20; A47C 17/86; A47C 7/506; A47C 7/5068
See application file for complete search history.

1
2

24
20
32
22
33
14
27
8
15
21
9
7
23
1
3
26

2
1
22
1
2
21
27

10
33
2
9
3
31
34
20
15
8

23 26
7
14

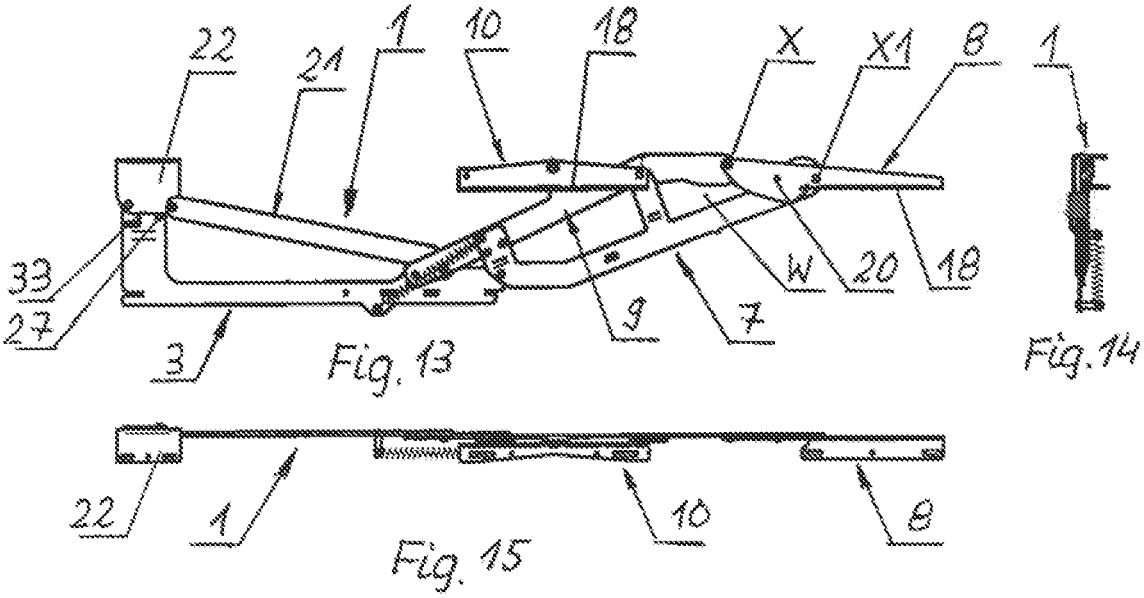
Fig. 13
Fig. 14
Fig. 15
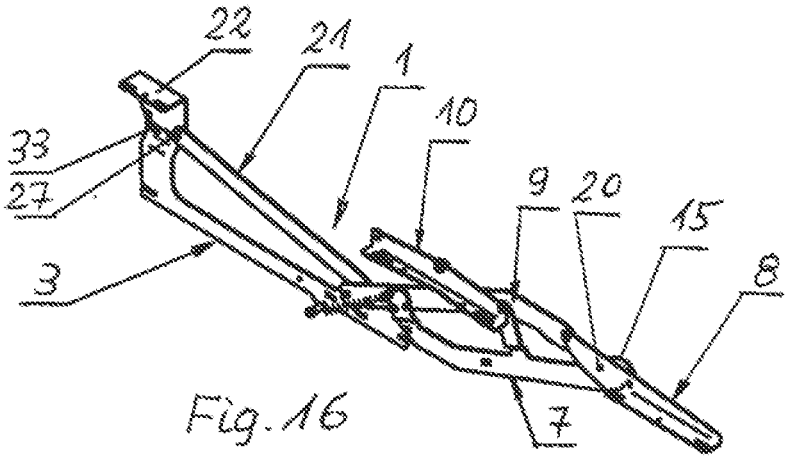
Fig. 16

MECHANISM FOR TRANSFORMING FURNITURE FROM A SITTING POSITION TO A LYING DOWN POSITION

CROSS-REFERENCE TO RELATED APPLICATIONS

Not applicable.

BACKGROUND OF THE INVENTION

1. Field of the Invention

The subject of the invention is a mechanism for transforming furniture from a sitting position to a lying down position. The invention is used in furniture, such as couches or corner sofas.

2. Description of Related Art Including Information Disclosed Under 37 CFR 1.97 and 37 CFR 1.98

A double mattress opening mechanism known from the description of a utility model PL 68476 Y1 is constructed from horizontal slats and two jacks, right and left with identical design, which are a mirror reflection of each other connected with each other by a synchronisation mechanism. Each of the jacks consists of a front and rear lever in the form of pull rods and angle slats, to which the mattresses are connected. Each of the jacks is attached in an articulated manner to a horizontal slat in the form of a horizontal flat bar with the bottom arm attached to furniture body. Two levers are attached in an articulated manner to the horizontal slat, front and rear, with angle slats attached to them in an articulated manner. The front lever has the shape of a flat bar with a permanently attached arm with a set-off in its central part, and the bottom part is rounded and permanently connected with a flat angle bar with a set-off with rounded ends. The rear lever has the shape of a flat bar similar to a letter "T" with rounded ends and a short centre arm. The mechanism is equipped with springs which assist the operation of the jacks, with one spring assigned to the right jack, and the second to the left jack. The spring is installed on a pin of the bottom arm of the horizontal slat and on the pin of the front lever's arm.

The known mechanism enables the transformation of the furniture, e.g. a sofa from the sitting position (folded position) to a recumbent position (unfolded position) by the unfolding of a double mattress, but without simultaneous lowering and raising of the furniture's backrest. The backrest is releasably attached to the body of the furniture with another separate mechanism containing a lever in the shape of a flat rectangle transitioning into a triangle with a rounded vertex, equipped with a pin and a socket containing two bent flat squares with a lengthwise opening which ends with a semicircle with a greater diameter.

In a known solution there are two independently operating mechanisms which facilitate opening and closing of elements of the furniture. One of them causes opening and closing of the double mattress, and the other one allows raising and lowering the furniture's backrest.

The design of the known mechanism does not ensure automatic lowering of the furniture backrest when opening it and raising the backrest when closing the furniture. The user must raise or lower the backrest manually, which is a drawback of the furniture. The previously known solution enables the closing and opening of the furniture in two stage, in the first stage the mechanism is opened and after it is opened in the second stage the backrest is manually rotated to horizontal.

BRIEF SUMMARY OF THE INVENTION

In order to eliminate the aforementioned drawbacks a mechanism, in two versions, for transforming furniture from a sitting position to a lying down position was created, which facilitates easy and effective unfolding of mattresses from a closed position to an open position while simultaneously lowering the furniture's backrest in a version with low and high legs.

A mechanism for transforming furniture from a sitting position to a lying down position according to the invention having two jacks, right and left, with identical design, which are a mirror reflection of each other connected with each other by a synchronisation mechanism, and each of these jacks has a fastening plate which attaches the jack to the furniture body, angle bars, upper and lower for connecting with the mattresses, a spring and a front pull rod and rear pull rod with centre arms, whereas the pull rods of each jack with one of their ends are connected in an articulated manner with the upper angle bar, and the second end are connected in an articulated manner with the fastening plate, and the centre arms are connected in an articulated manner with the bottom angle bar, wherein each jack has a backrest driving sub-assembly created from the backrest rotation pull rod and support to be connected with the backrest of the furniture, whereas the backrest rotation pull rod is connected in an articulated manner on one end with the bottom end of the rear pull rod, and on the second end is connected in an articulated manner with the support connected in an articulated manner to the fastening plate.

Each jack contains a stop pin set in the upper angle bar and directed towards the front pull rod and the rear pull rod and the stop pin set in the fastening plate and directed towards the support.

The stop pin set in the upper angle bar which is placed between the articulated connection of the front pull rod with the upper angle bar and the articulated connection of the rear pull rod with the upper angle bar.

The stop pin set in the fastening plate is located near the articulated connection of the support with the fastening plate.

Each jack has a bearing surface located at the end of the front pull rod from the side of the rear pull rod.

In the rear pull rod of each jack the upper end is inclined towards the front pull rod.

In each of the jacks the kinematic node created at the articulated connection of the rear pull rod with the upper angle bar is located above the kinematic node created at the articulated connection of the front pull rod with the upper angle bar.

In the first version of the mechanism, in every jack in the opened position the shelf of the upper angle bar and the shelf of the lower angle bar are placed on the same level.

In the second version of the mechanism, in each jack in the opened position the shelf of the upper angle bar is located below the shelf of the lower angle bar.

The construction of the mechanism according to the invention enables the performance of functionality in which one movement is used to open the furniture from a closed position (sitting position) to an open position (lying down position) and one movement is used to close the furniture from the open position to the closed position, whereas both when opening and when closing the furniture an automatic actuation occurs of a mechanism which moves mattresses while simultaneously rotating the backrest. The construction of the mechanism enables easy and effective movement of the mattresses from the closed position to the opened position while simultaneously lowering the backrest and moving the mattresses from the open position to the closed position with simultaneous raising of the backrest. Raising and lowering of the backrest occurs without the participation of the user, which decidedly improves utility.

Each of the jacks of the mechanism according to the invention is equipped with a backrest driving mechanism created by a backrest rotation pull rod coupled by a support to the backrest, with this pull rod moving the backrest by the movement of the main pull rods of the jack. The kinematic points of the backrest rotation pull rod and its length are adapted in a manner which ensures the free movement of the mechanism built into the furniture. This also ensures collision-free movement of mattresses of the backrest and base when unfolding the furniture for lying down, or folding the furniture to sit down.

Bottom horizontal location of the angle bar shelves enables the use of thicker mattresses in the furniture.

The design of the jacks by the creation of free space between the front and rear pull rods during the mechanism movement cycle prevents the creation of a shearing phenomenon between the sides of the pull rods, eliminating the possibility of cutting of fingers when opening and closing the furniture, making the mechanism safe to use.

Due to the fact that the kinematic node created at the articulated connection of the rear pull rod with the upper angle bar is located above the remaining kinematic nodes created at the articulated connections of pull rods with angle bars, during the operation of the mechanism the forces acting on subsequent nodes are low, which ensures that the mechanism is stable and ergonomic and operates smoothly. The upper angle bar with the mattress in the initial phase of opening the furniture for sleeping inclines at an angle to the floor, which facilitates the opening of a sofa with short legs.

The placement of the lower angle bar shelf, which in a furniture with long legs is placed significantly above the shelf of the upper angle bar in an opened position of the mechanism means that the mechanisms is more compact and may be used in furniture with long legs.

BRIEF DESCRIPTION OF THE SEVERAL VIEWS OF THE DRAWINGS

The subject of the invention is shown in example implementations on a figure, where

FIG. 9 illustrates the jack of the mechanism in an intermediate position in a side view in a version for furniture with short legs.

FIG. 9*a* illustrates the upper angle bar with the set stop pin in the A-A cross-section marked on FIG. 9.

FIG. 9*b* illustrates the fastening plate with the set stop pin in the B-B cross-section marked on FIG. 9.

FIG. 10 illustrates the jack of the mechanism from FIG. 9 in a rear view.

FIG. 13 illustrates the jack of the mechanism in an open position in a side view in a version for furniture with short legs.

FIG. 14 illustrates the jack of the mechanism from FIG. 13 in a rear view.

FIG. 15 illustrates the jack of the mechanism from FIG. 13 in a top view.

FIG. 16 illustrates the jack of the mechanism from FIG. 13 in an isometric view.

DETAILED DESCRIPTION OF THE INVENTION

Figures 1, 2, 3, 4:
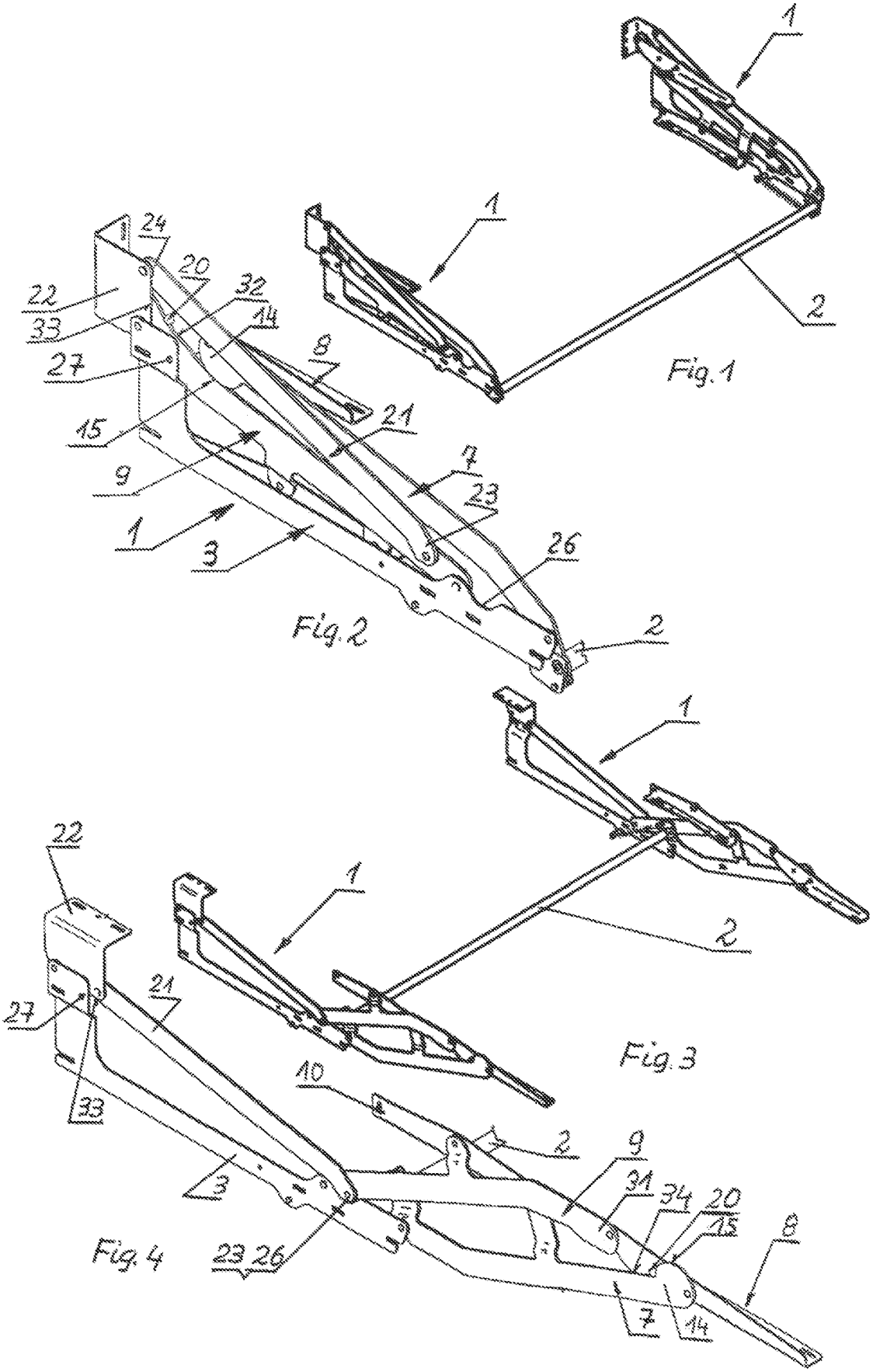
FIG. 1 presents the mechanism in closed position in an isometric view in a version for furniture with short legs.
FIG. 2 illustrates the jack of the mechanism from FIG. 1 in a closed position in an enlarged isometric view.
FIG. 3 illustrates the mechanism from FIG. 1 in an open position in an isometric view.
FIG. 4 illustrates the jack of the mechanism from FIG. 1 in an open position in an enlarged isometric view.
Figure 5:
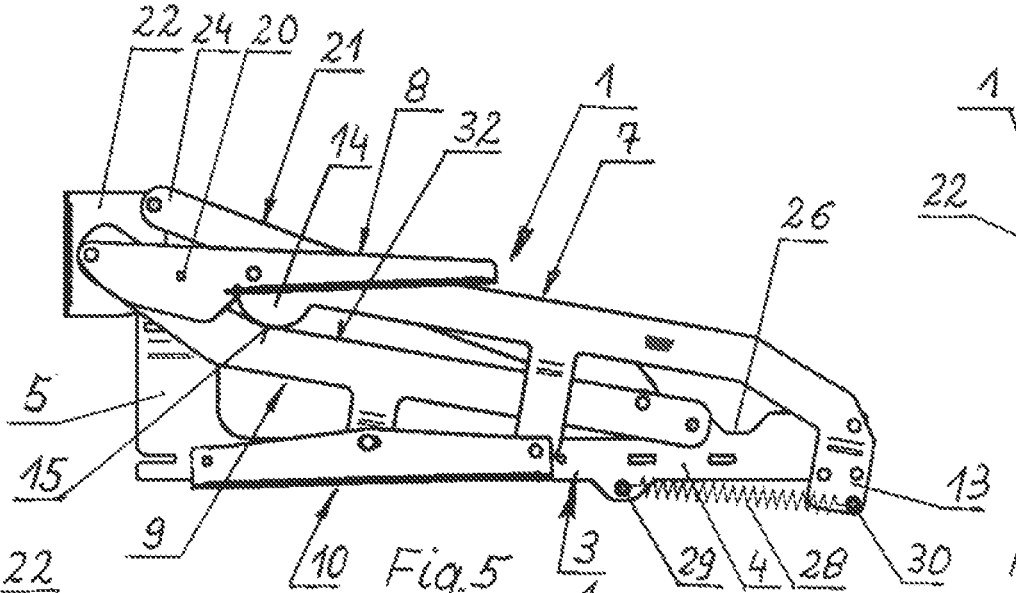
FIG. 5 illustrates the jack of the mechanism in a closed position in a side view in a version for furniture with short legs.
Figure 6:
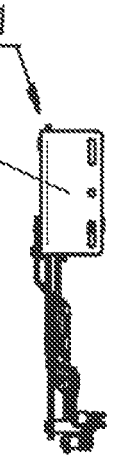
FIG. 6 illustrates the jack of the mechanism from FIG. 5 in a rear view.
Figure 7:
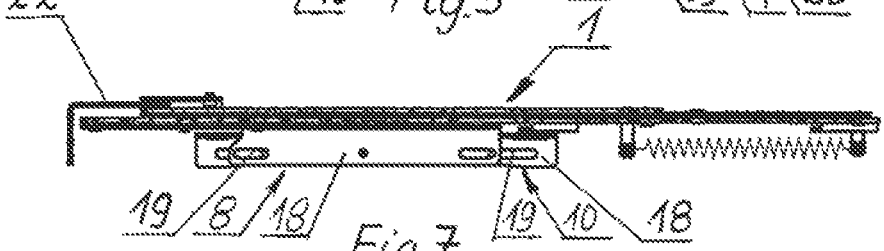
FIG. 7 illustrates the jack of the mechanism from FIG. 5 in a top view.
Figure 8:
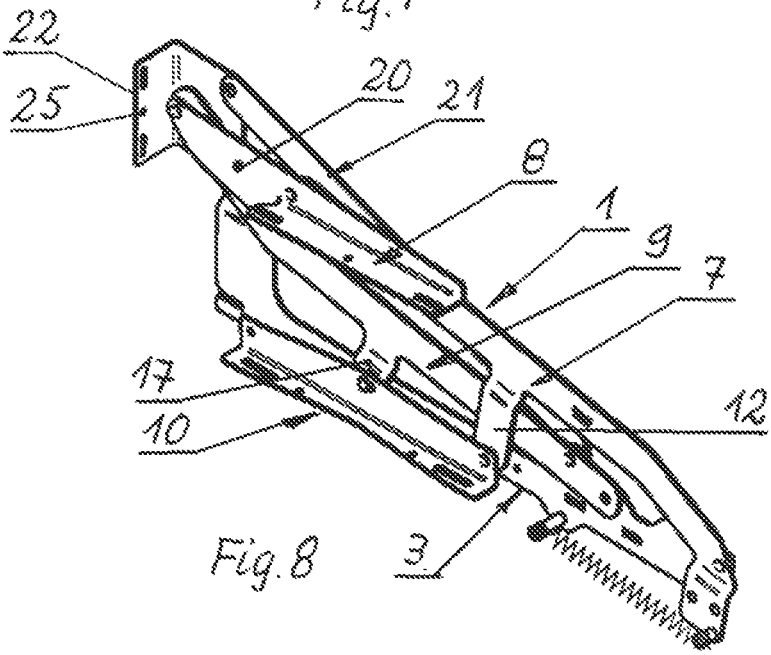
FIG. 8 illustrates the jack of the mechanism from FIG. 5 in an isometric view.
Figure 11:
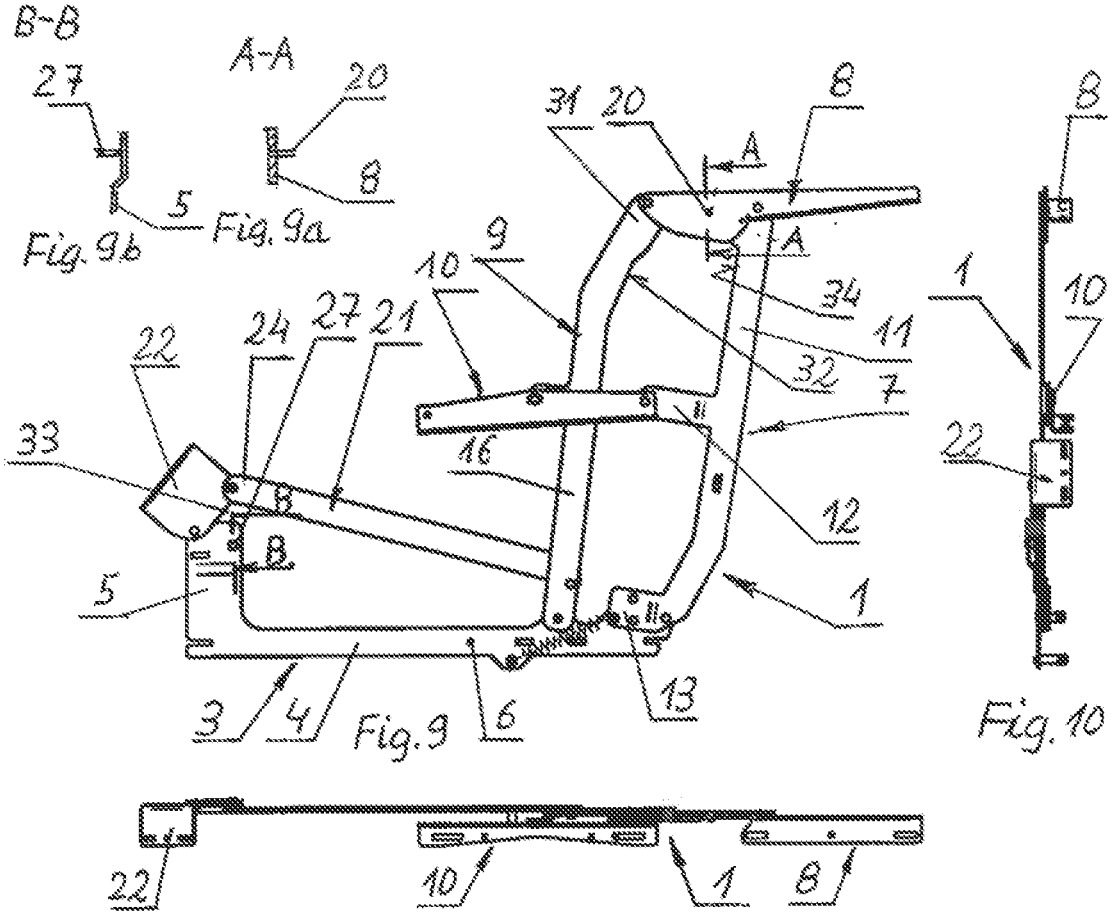
FIG. 11 illustrates the jack of the mechanism from FIG. 9 in a top view.
Figure 12:
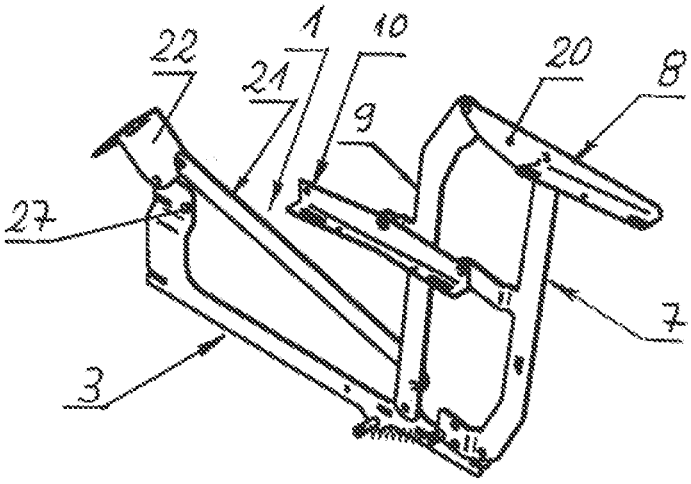
FIG. 12 illustrates the jack of the mechanism from FIG. 9 in an isometric view.
Figure 17:
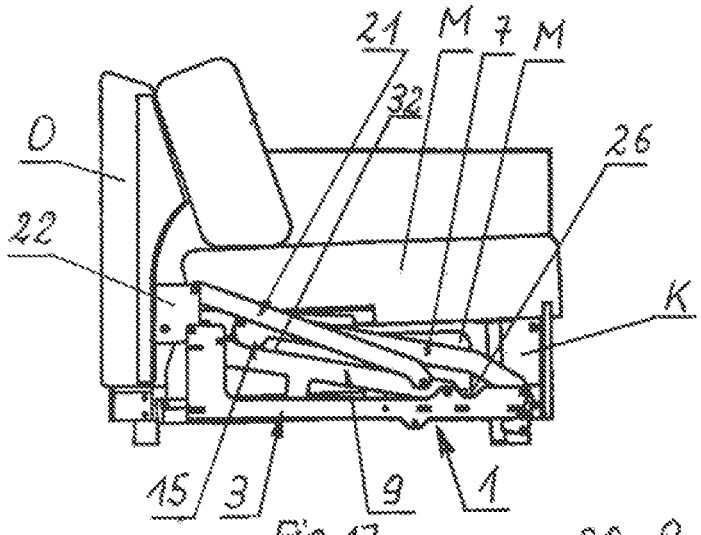
FIG. 17 illustrates the mechanism in a version for furniture with short legs placed in the furniture in a closed position in a side view.
Figure 18:
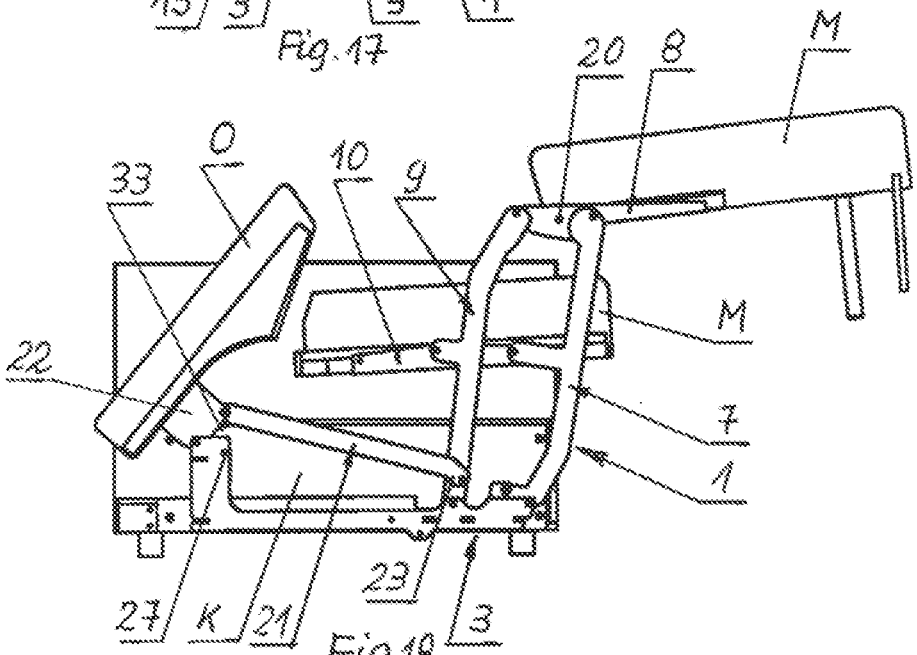
FIG. 18 illustrates the mechanism in a version for furniture with short legs placed in the furniture in an intermediate position in a side view.
Figure 19:
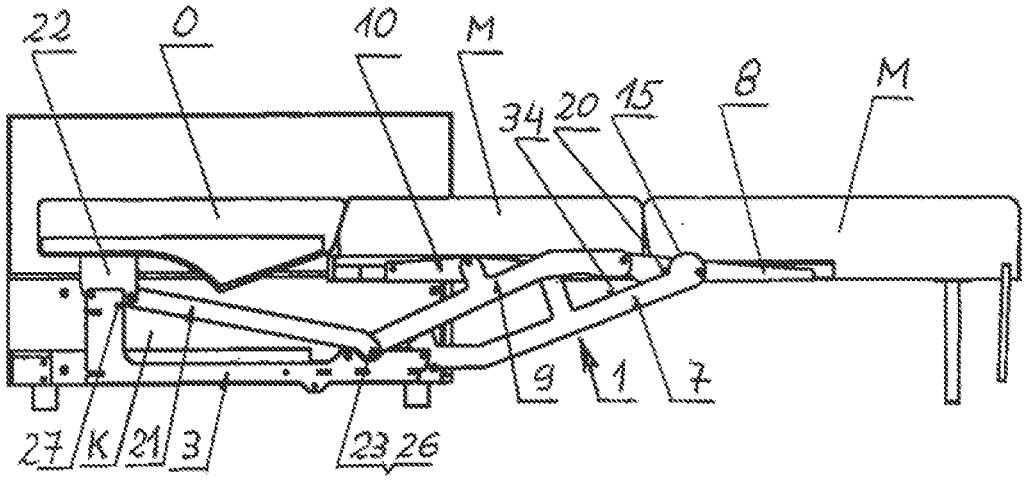
FIG. 19 illustrates the mechanism in a version for furniture with short legs placed in the furniture in an open position in a side view.
Figure 20:
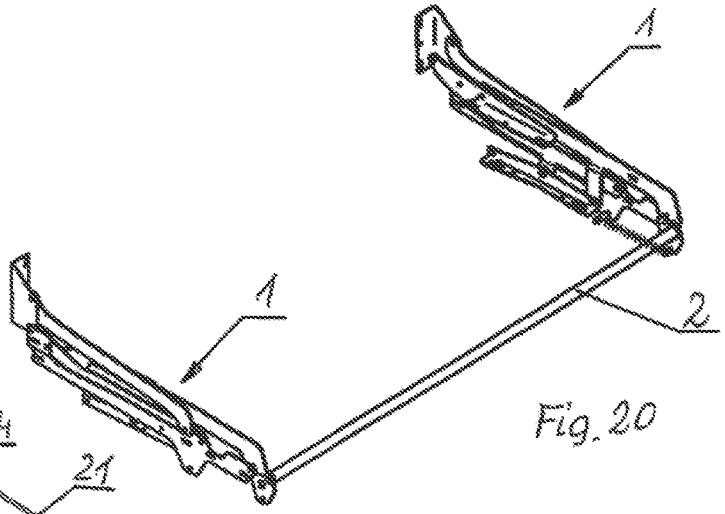
FIG. 20 illustrates the mechanism in closed position in an isometric view in a version for furniture with long legs.
Figure 21:
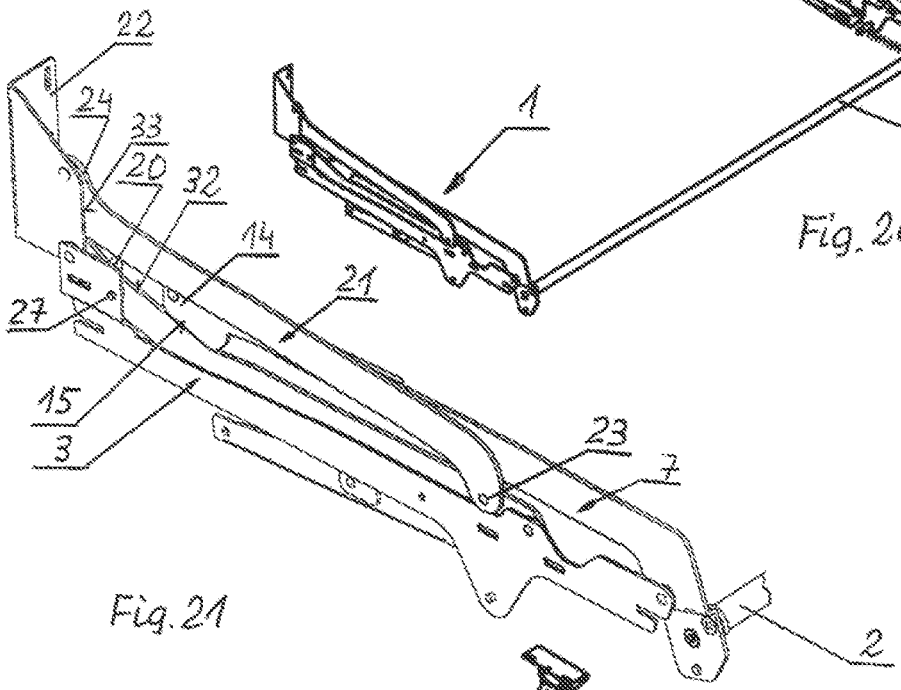
FIG. 21 illustrates the jack of the mechanism from FIG. 20 in a closed position in an enlarged isometric view.
Figure 22:
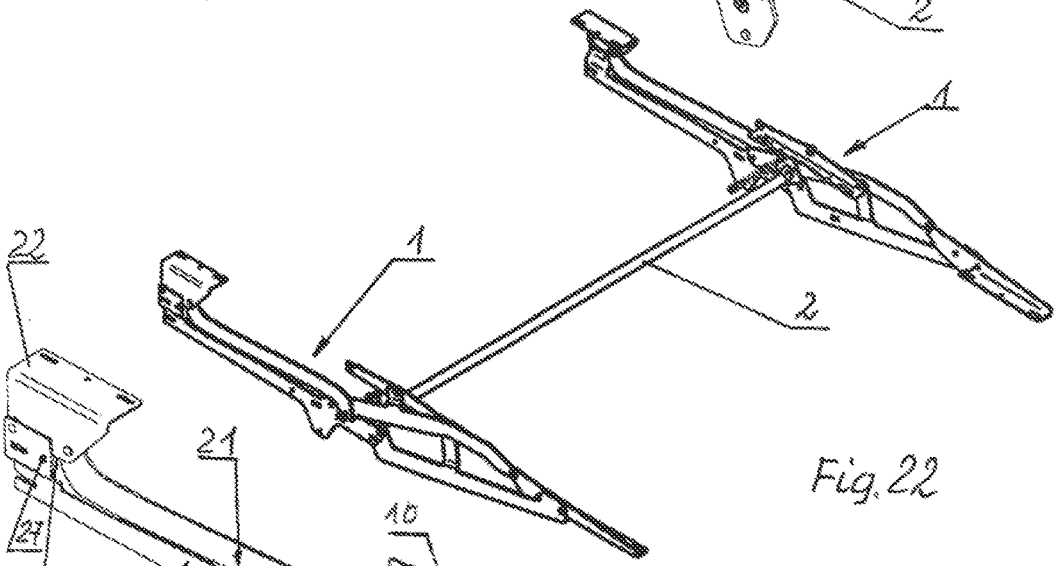
FIG. 22 illustrates mechanism from FIG. 20 in an open position in an isometric view.
Figure 23:
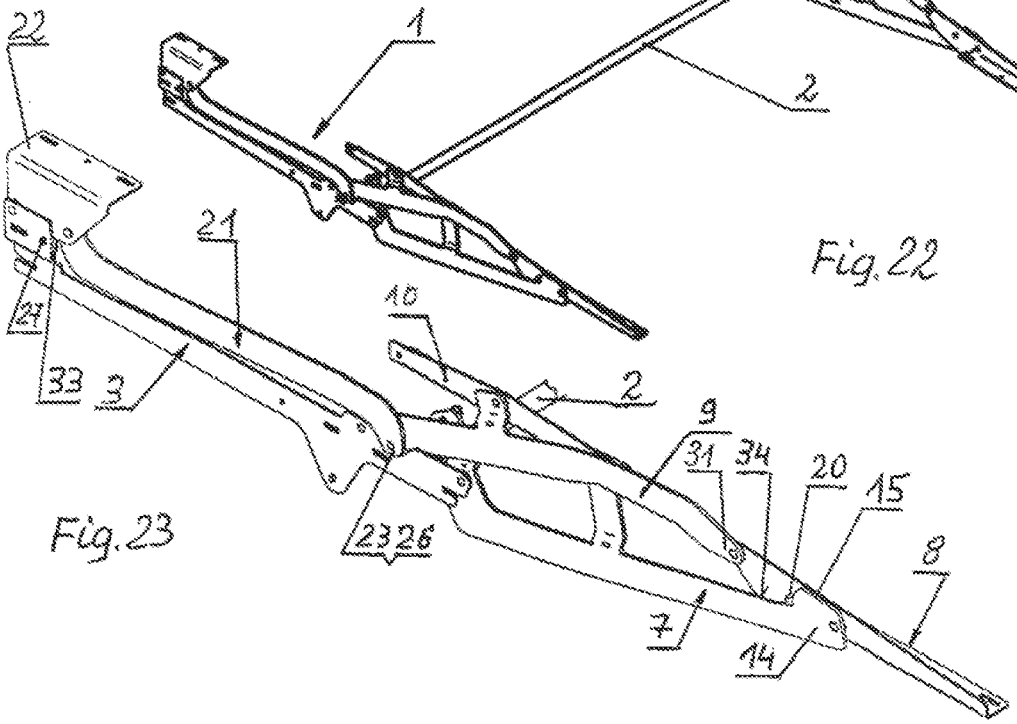
FIG. 23 illustrates the jack of the mechanism from FIG. 22 in an open position in an enlarged isometric view.
Figure 24:
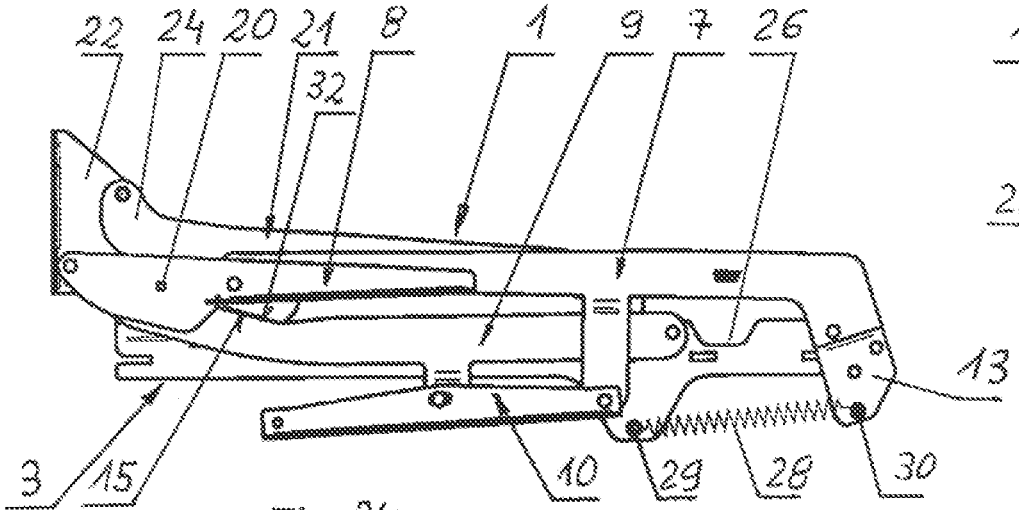
FIG. 24 illustrates the jack of the mechanism in a closed position in a side view in a version for furniture with long legs.
Figure 25:
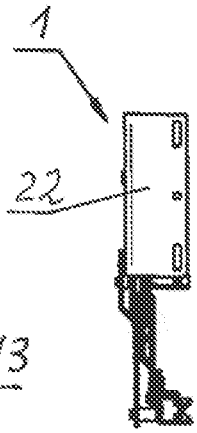
FIG. 25 illustrates the jack of the mechanism from FIG. 24 in a rear view.
Figure 26:
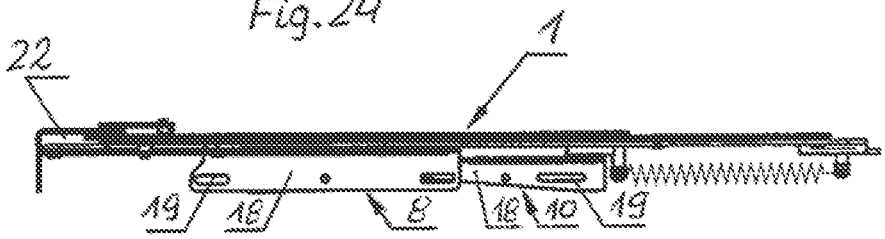
FIG. 26 illustrates the jack of the mechanism from FIG. 24 in a top view.
Figure 27:
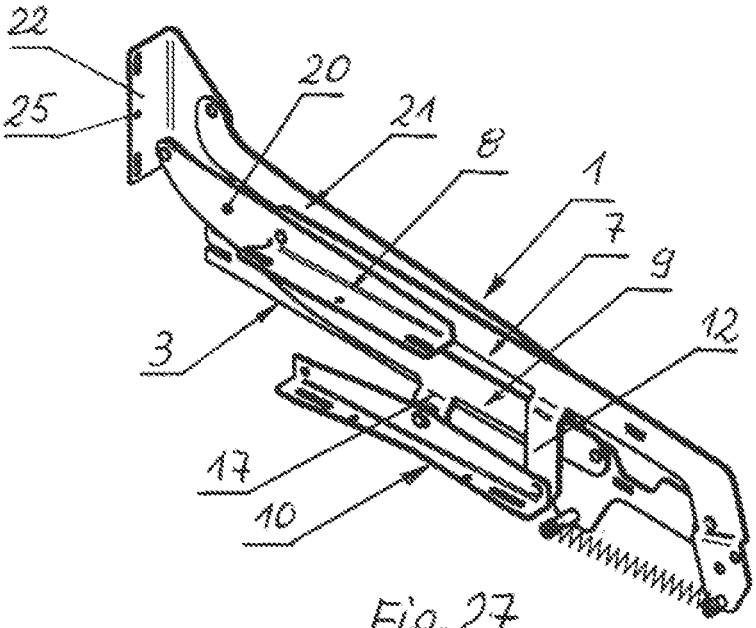
FIG. 27 illustrates the jack of the mechanism from FIG. 24 in an isometric view.
Figure 28B:
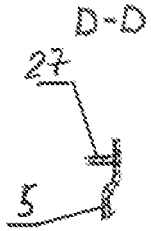
FIG. 28*b* illustrates the fastening plate with the set stop pin in the D-D cross-section marked on FIG. 28.
Figure 28A:
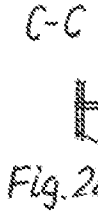
FIG. 28*a* illustrates the upper angle bar with the set stop pin in the C-C cross-section marked on FIG. 28.
Figure 28:
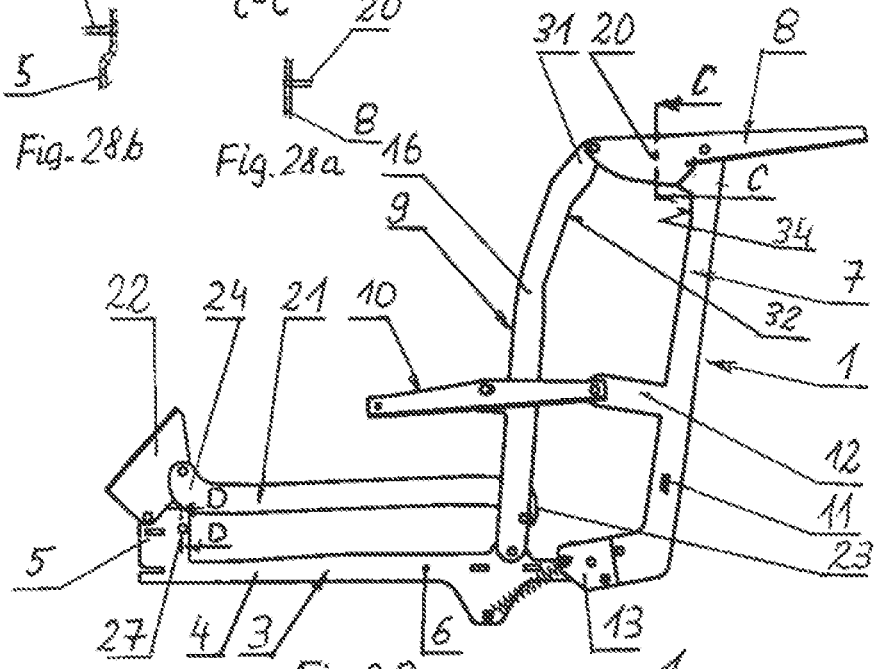
FIG. 28 illustrates the jack of the mechanism in an intermediate position in a side view in a version for furniture with long legs.
Figure 29:
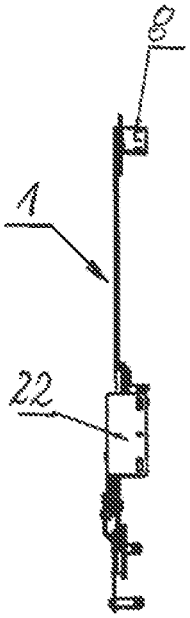
FIG. 29 illustrates the jack of the mechanism from FIG. 28 in a rear view.
Figure 30:
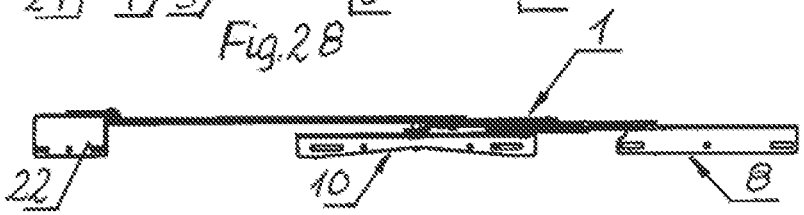
FIG. 30 illustrates the jack of the mechanism from FIG. 28 in a top view.
Figure 31:
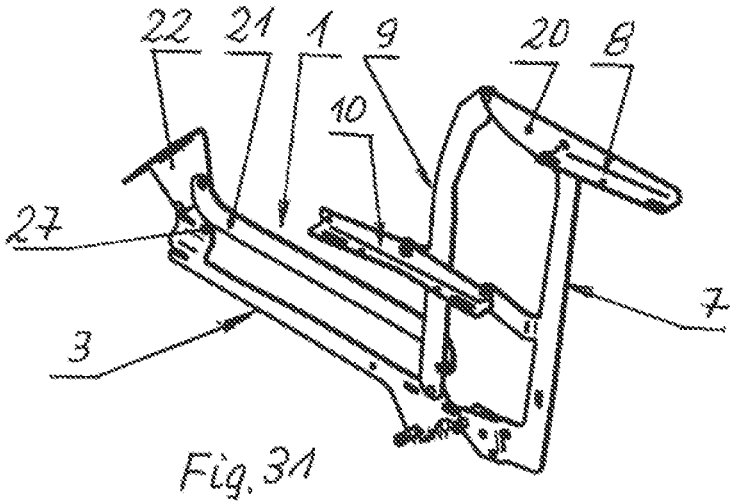
FIG. 31 illustrates the jack of the mechanism from FIG. 28 in an isometric view.
Figure 32:
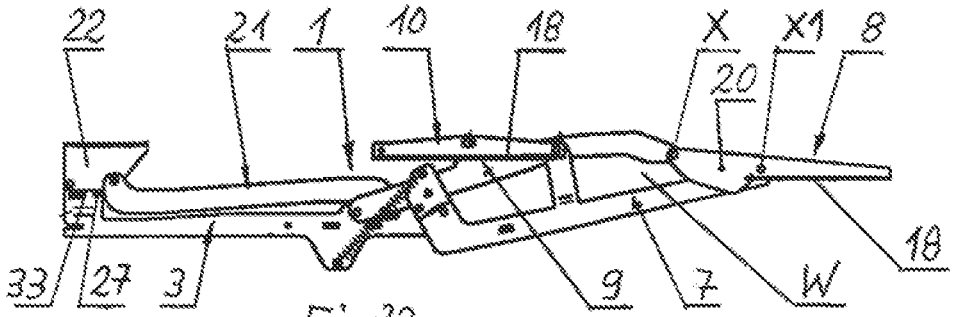
FIG. 32 illustrates the jack of the mechanism in an open position in a side view in a version for furniture with long legs.
Figure 33:
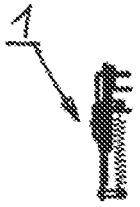
FIG. 33 illustrates the jack of the mechanism from FIG. 32 in a rear view.
Figure 34:
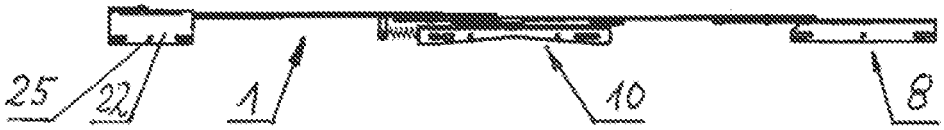
FIG. 34 illustrates the jack of the mechanism from FIG. 32 in a top view.
Figure 35:
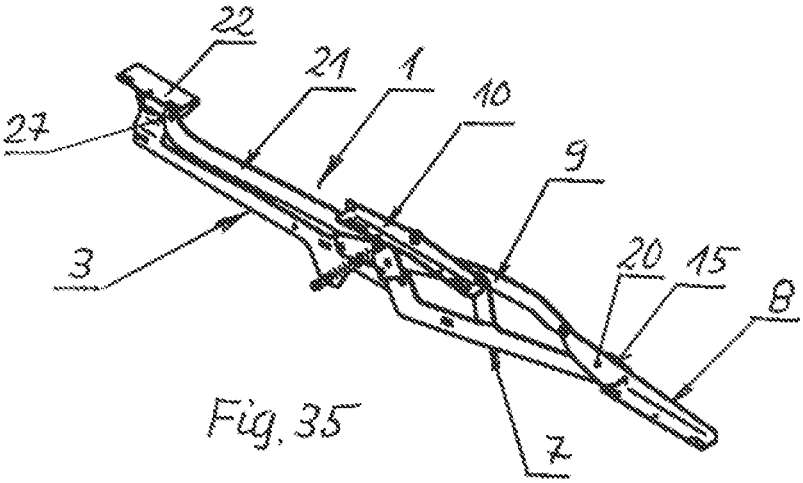
FIG. 35 illustrates the jack of the mechanism from FIG. 32 in an isometric view.
Figure 36:
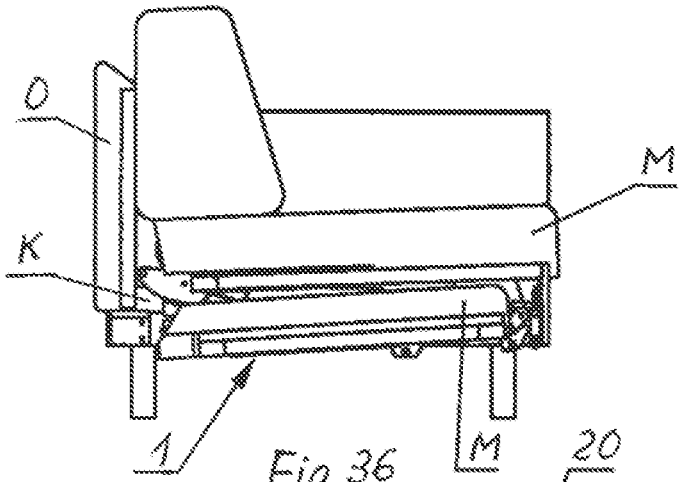
FIG. 36 illustrates the mechanism in a version for furniture with long legs placed in the furniture in a closed position in a side view.
Figure 37:
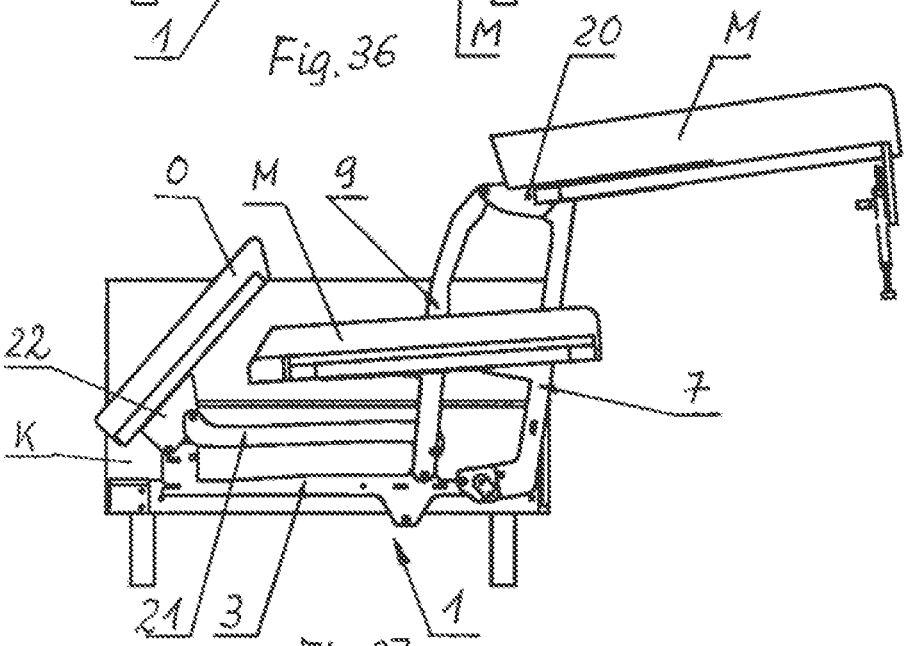
FIG. 37 illustrates the mechanism in a version for furniture with long legs placed in the furniture in an intermediate position in a side view.
Figure 38:
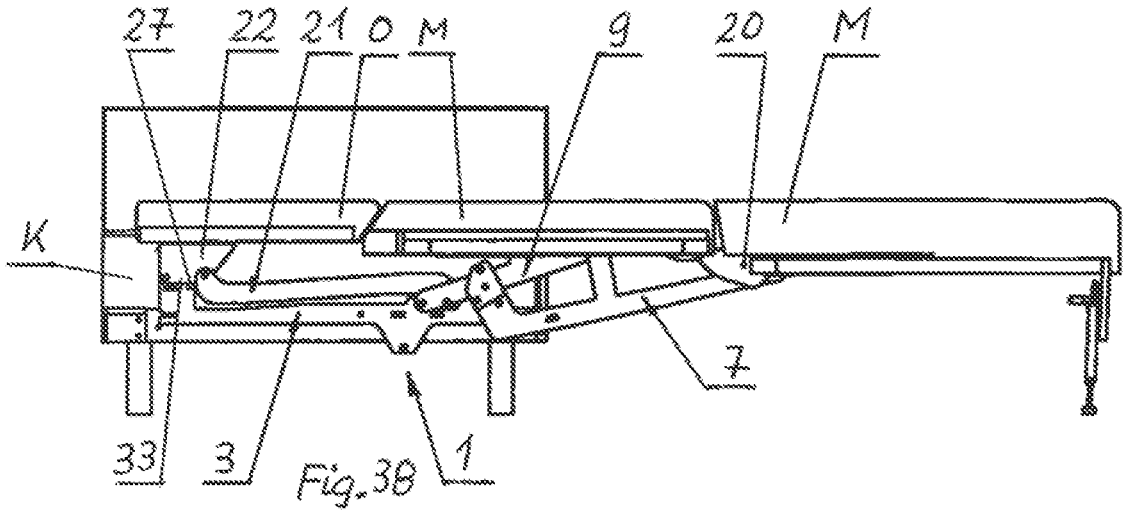
FIG. 38 illustrates the mechanism in a version for furniture with long legs placed in the furniture in an open position in a side view.

Mechanism for transforming furniture from a sitting position to a lying down position according to the invention has two jacks 1, right and left, with an identical design, which are a mirror reflection of each other. Jacks 1 are connected with each other by a synchronisation mechanism 2.

Each of the jacks 1 of the mechanism consists of a fastening plate 3, a front pull rod 7 with its lower end connected in an articulated manner with the fastening plate 3 and its upper end connected in an articulated manner with the upper angle bar 8 and the rear pull rod 9 with its lower end connected in an articulated manner with the fastening plate 3 and its upper end connected in an articulated manner with the upper angle bar 8.

The fastening plate 3 consists of a horizontal part 4 with its rear end transitioning into a vertical part 5. The fastening plate 3 contains assembly openings 6 used to attach the fastening plate 3 to the furniture body K.

The front pull rod 7 has the shape of a flat bar 11. The flat bar 11 in its centre part has a centre arm 12 directed towards the rear pull par 9, and in its bottom part the flat bar 11 has a bottom arm 13 directed towards the fastening plate 3. The upper end 14 of the front pull rod 7 from the side of the rear pull rod 9 has a bearing surface 15.

The rear pull rod 9 has the shape of a flat bar 16 with rounded ends. The flat bar 16 in its middle part has a centre arm 17. The upper end 31 of the rear pull rod 9 is inclined towards the front pull rod 7. This shape of the rear pull rod 9 ensures the creation of a free space W between the pull rods 9, 7 during the operation of the mechanism.

The front pull rod 7 with the end of its centre arm 12 is connected in an articulated manner with the bottom angle bar 10 in its front part, and the rear pull rod 9 with the end of its centre arm 17 is connected in an articulated manner with the bottom angle bar 10 in its centre part.

The angle bars 8, 10 of each jack 1 are placed on the jack 1 in such a manner that the shelves 18 are in a bottom horizontal position. On shelves 18 there are openings 19 intended to connect the angle bars 8, 10 with mattresses M.

Each jack 1 has a backrest O driving sub-assembly created from the backrest O rotation pull rod 21 and support 22 intended for connection with the furniture's backrest O. The pull rod 21 has the form of a flat bar and is connected in an articulated manner on one end 23 with the lower end of the rear pull rod 9, and on the other end 24 is connected in an articulated manner with the support 22 connected in an articulated manner to the upper end of the vertical part 5 of the fastening plate 3. The support 22 rotates in relation to the fastening plate 3. The support 22 contains assembly holes 25 for connecting to the backrest O.

In the front part of the fastening plate 3 a recess 26 is located, placed between the articulated connection of the rear pull rod 9 with the fastening plate 3 and the articulated connection of the front pull rod 7 with the fastening plate 3.

Each jack 1 contains a stop pin 20 placed on the upper angle bar 8 and directed towards the front pull rod 7 and the rear pull rod 9 and the stop pin 27 set in the fastening plate 3 and directed towards the support 22.

The stop pin 20 set in the upper angle bar 8 is placed between the articulated connection of the front pull rod 7 with the upper angle bar 8 and the articulated connection of the rear pull rod 9 with the upper angle bar 8.

The stop pin 27 set in the fastening plate 3 is located near the articulated connection of the support 22 with the fastening plate 3.

The mechanism is equipped with springs 28, which are placed on bolts 29 set in the fastening plates 3 and bolts 30 set in the bottom arms 13 of the front pull rods 7.

In each of the jacks 1 the kinematic node X created at the articulated connection of the rear pull rod 9 with the upper angle bar 8 is located above the kinematic node X1 created at the articulated connection of the front pull rod 7 with the upper angle bar 8.

A mechanism according to the invention is made in two versions.

In the first version, intended for furniture with short legs in each of the jacks 1 in the open position, the shelf 18 of the upper angle bar 8 and the shelf 18 of the lower angle bar 10 are placed on the same level.

In the second version, intended for furniture with long legs in each of the jacks 1 in the open position, the shelf 18 of the upper angle bar 8 is placed below the shelf 18 of the lower angle bar 10.

In order to unfold the furniture from the sitting position to the lying down position, the front part of the furniture is pulled out from the body K. When pulling out as a result of the action of the mechanism the front mattress M slides out and is raised, and then the rear mattress M, in which the surfaces for lying down of both mattresses M are placed in a single plane. Simultaneously during the opening as a result of the action of pull rods 21 on the supports 22 the backrest O attached in a tilting manner is lowered. The springs 28 support the raising of mattresses M when opening the furniture. In the final phase the backrest O lowered to a horizontal position along with the mattresses M creates a single large surface for lying down.

In order to fold the furniture from a lying down position to a sitting position the mattresses M are pulled in using the mechanism, until they retract into the furniture. At the same time during the pulling in of mattresses M through the action of pull rods 21 on the supports 22 the backrest O attached in a tilting manner is raised.

Raising and lowering of the backrest O is the result of the action of pull rods 21 on supports 22 attached to the backrest O.

Closed position of the jack 1 is established by resting the stop pin 20 set in the upper angle bar 8 on the side 32 of the rear pull rod 9 and resting the bearing surface 15 of the front pull rod 7 on the side 32 of the rear pull rod 9.

Open position of the jack 1 is established by resting the side 33 of the support 22 on the stop pin 27 set in the fastening plate 3 and resting the stop pin 20 on the upper end 14 of the front pull rod 7 at the place where the side 34 of the front pull rod 7 transitions into the bearing surface 15.

We claim:

1. An apparatus for transforming an article of furniture from a sitting position to a lying down position, the article of furniture having a backrest and a seat, the apparatus comprising:

a pair of jacks having an identical configuration, one jack of said pair of jacks being a mirror reflection of another jack of said pair of jacks;

a synchronization mechanism connecting the one jack to the other jack of said pair of jacks, wherein each of said pair of jacks comprises:

a fastening plate affixed to each of said pair of jacks, said fastening plate adapted to attach the jack to the article of furniture;

an upper angle bar;

a lower angle bar, said upper angle bar and said lower angle bar adapted to connect to the seat;

a front pull rod having a center arm;

a rear pull rod having a center arm, said front pull rod and said rear pull rod having one end articulated to said upper angle bar, said front pull rod and said rear pull rod having an opposite end articulated to said fastening plate, the center arm of said front pull rod and the center arm of said rear pull rod being articulated to said lower angle bar; and a backrest driving assembly having only a backrest rotation link and a bracket adapted to connect to the backrest of the article of furniture, said backrest rotation link articulated on one end to a bottom end of said rear pull rod and an opposite end hinged on to the bracket, the bracket being hinged to said fastening plate, wherein said backrest driving assembly raises or lowers the backrest relative to a position of the seat.

2. The apparatus of claim 1, wherein each jack of said pair of jacks comprises; a stop pin set in said upper angle bar and directed toward said front pull rod and said rear pull rod; and a stop pin set in said fastening plate and directed towards the bracket.

3. The apparatus of claim 2, wherein said stop pin set in said upper angle bar is positioned between an articulation of the front pull rod with said upper angle bar and the articulation of said rear pull rod with said upper angle bar.

4. The apparatus of claim 1, wherein said stop pin set in said fastening plate is positioned adjacent an articulation of the bracket with said fastening plate.

5. The apparatus of claim 1, wherein each jack of said pair of jacks further comprising:

a bearing surface located on an upper end of said front pull rod on a side of said rear pull rod.

6. The apparatus of claim 1, wherein said rear pull rod has an upper end inclined toward said front pull rod.

7. The apparatus of claim 1, wherein each jack of said pair of jacks further comprising:

a first kinematic node formed at an articulation of said rear pull rod with said upper angle bar;

a second kinematic node formed at an articulation of said front pull rod with said upper angle bar, said first kinematic node positioned above said second kinematic node.

8. The apparatus of claim 1, wherein said upper angle bar has a shelf and said lower angle bar has a shelf, wherein the shelf of said upper angle bar and the shelf of said lower angle bar are at a common level when each jack of said pair of jacks is in an open position.

* * * * *